United States Patent [19]

Nagy

[11] 4,249,321

[45] Feb. 10, 1981

[54] HEEL PROTECTOR

[76] Inventor: Mary J. Nagy, 9 Curtis St., Bloomfield, N.J. 07003

[21] Appl. No.: 73,337

[22] Filed: Sep. 7, 1979

[51] Int. Cl.[3] ..... A43B 13/22

[52] U.S. Cl. ..... 36/72 B

[58] Field of Search ..... 36/72 B, 72 R, 58.5; D2/277

[56] References Cited

U.S. PATENT DOCUMENTS

| | | | |
|---|---|---|---|
| 1,489,735 | 4/1924 | Briggs | 36/58.5 |
| 2,988,830 | 6/1961 | Zacks | 36/72 B |
| 3,063,172 | 11/1962 | Beattle | 36/72 B |
| 3,983,641 | 10/1976 | Wright | 36/72 B |

FOREIGN PATENT DOCUMENTS

| | | | |
|---|---|---|---|
| 600978 | 11/1925 | France | 36/72 B |
| 256864 | 8/1926 | United Kingdom | 36/72 B |

*Primary Examiner*—James Kee Chi

*Attorney, Agent, or Firm*—David A. Jackson

[57] ABSTRACT

A heel protector usable by both men and women comprising a cover means having a generally hourglass-shaped perimeter and adapted to shroud the back and bottom surfaces of the heel, and including two leaf members, each leaf member having a wide end, a narrow end and tapering peripheral margins extending therebetween. The heel protector includes a pocket formed by the attachment of the narrow ends, which serves to cradle the rear-most leading edge of the heel of the wearer. The heel protector is held securely in place by an elastic means adapted to extend around the instep of the wearer, which comprises a generally X-shaped web member connecting the peripheral margins of the leaf members so that the leaf members are drawn toward each other and into snug contact with the back and bottom surfaces of the heel when the heel protector is placed over the heel and instep of the wearer. In one embodiment, the heel protector may employ a cover means comprised of leaf members prepared from separate segments and material which have been juxtaposed, aligned along their narrow ends and bonded together, whereby the leaf members are biased toward each other, and the pocket, viewed in lateral cross section, subtends an angle of less than 180°. The present heel protector is inexpensively manufactured and easily employed, and is adapted by its configuration to fit a variety of sizes and shapes of shoes.

14 Claims, 7 Drawing Figures

HEEL PROTECTOR

BACKGROUND OF THE INVENTION

The present invention relates to heel protectors, and more particularly to protectors adapted for use with all sizes of men's and women's shoes, without exhibiting the tendency to slip off.

A variety of heel protectors are well-known in the art, which have employed numerous shapes and structural features in order to provide proper fit and securement to the shoes of the wearer. Major problems that have been encountered with the use of these devices has been their tendency to slip out of position in use, or in the alternative, to damage the shoe structure by their tenacious attachment thereto. Thus, the art is replete with a variety of heel protector configurations, and those protectors disclosed in U.S. Pat. Nos. 2,894,339 to Shapiro, 3,217,430 to Novick and 3,861,399 to Huff are cited as exemplary thereof. Furthermore, Australian Pat. No. 4687/26 to Bland and French Pat. No. 2,338,664 to Lamotte, also illustrate the types of devices known and employed in the prior art.

All of the foregoing constructions suffer from one or more defects. Thus, the devices disclosed in the French patent, Australian patent, and U.S. patents to Novick, Huff and Shapiro, all appear to rely on specific configurations of their products to account for variations in shoe size and configuration. The disadvantage in this type of construction is clear, as the wearer must possess a variety of these devices configured to the shoes owned.

Further, the devices disclosed in Novick, the French patent, and to a lesser extent the device disclosed in Bland, all rely upon the securement of the protector by encirclement of the heel of the shoe. This type of securement, however, is subject to failure in the instance where extensive abrasion causes the heel protector to shift position along the heel, and to overcome the frictional resistance imposed by the encircling member.

Finally, those devices suggesting a variety of shapes nonetheless rely upon the close fit of the device to the shoe in question. Even the Australian patent to Bland, which employs a strap that extends over the instep of the wearer, nonetheless requires that the remainder of the protector be of close resemblance in size and shape to the wearer's shoe.

None of the prior art appears to have addressed the problem of developing a heel protector which may maintain a general configuration adaptable to all shapes and sizes of shoes, and which possesses a securement means which effectively prevents disengagement of the protector due to the application of excessive frictional forces during use.

SUMMARY OF THE INVENTION

In accordance with the present invention, a heel protector is disclosed which comprises a generally hourglass-shaped cover means adapted to shroud the side and bottom surfaces of the heel, and including two leaf members prepared from a flexible material. Each of the leaf members has a wide end, a narrow end and tapering peripheral margins extending therebetween, and the leaf members are connected to each other at the narrow ends.

The present heel protector further includes a pocket formed by the attachment of the narrow ends of the leaf members, which serves to cradle the rear-most leading edge of the heel of the wearer. The cover means is maintained in secure position adjacent the heel by an elastic means adapted to extend around the instep of the wearer, which comprises a generally X-shaped web member connecting the peripheral margins of the leaf members. The web member serves to draw the leaf members toward each other and into snug contact with the side and bottom surfaces of the heel of the wearer when the heel protector is placed over the heel and instep.

The heel protector of the present invention may be inexpensively manufactured from a variety of well-known and widely available flexible materials, including textiles and plastics. In a preferred embodiment, the cover means may be of composite construction including an inner pad or liner. Likewise, the cover means may be prepared from a single segment of material, or the individual leaf members may be prepared and then bonded together at their narrow ends.

The pocket defined by the convergence of the narrow ends of the respective leaf members provides a cradle for the rear-most or trailing edge of the heel of the wearer, to assist in retaining the heel protector in position during use. The pocket defines in lateral cross section an angle of less than 180°, and in a preferred embodiment, defines an angle of less than 90°. The leaf members are biased toward each other and urge the heel protector into a compact, folded-over disposition with the inner surfaces of the leaf members juxtaposed, when the heel protector is not in use.

The design and construction of the present heel protector renders it universally adaptable to all sizes and shapes of shoes and feet.

Accordingly, it is a principle object of the present invention to provide a heel protector which securely covers the back surfaces and lower surfaces of the heel of the wearer to prevent abrasion to footwear during the operation of an automobile.

It is the further object of the present invention to provide a heel protector as aforesaid which is inexpensively constructed from a widely available class of materials.

It is the further object of the present invention to provide a heel protector as aforesaid which is universally adaptable without modification to all sizes and shapes of shoes and feet.

It is a yet further object of the present invention to provide a heel protector as aforesaid which is easily positioned and removed from the heel of the foot, and is of compact construction making it easy to carry on the person.

Other objects and advantages will become apparent to those skilled in the art from a consideration of the ensuing description which proceeds with reference to the following accompanying drawings.

DETAILED DESCRIPTION OF THE INVENTION

Figure 1:
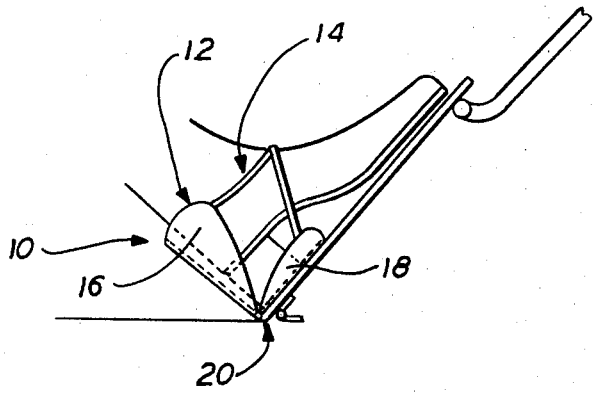
FIG. 1 is a side elevational view partly in phantom illustrating the heel protector of the present invention in use during the operation of a motor vehicle.

Referring now to the figures wherein like numerals designate like parts throughout, and particularly to FIG. 1, the heel protector 10 comprises a cover means 12 which is adapted to shroud the back surface and bottom surface of the heel of the wearer. Cover means 12 is held in position against the heel of the wearer by an elastic means comprising an X-shaped web member 14. Cover means 12 is defined by leaf members 16 and 18 which form at their junction pocket 20 which receives the rear-most leading edge of the heel of the wearer, as illustrated in phantom in the figure.

Figure 2:
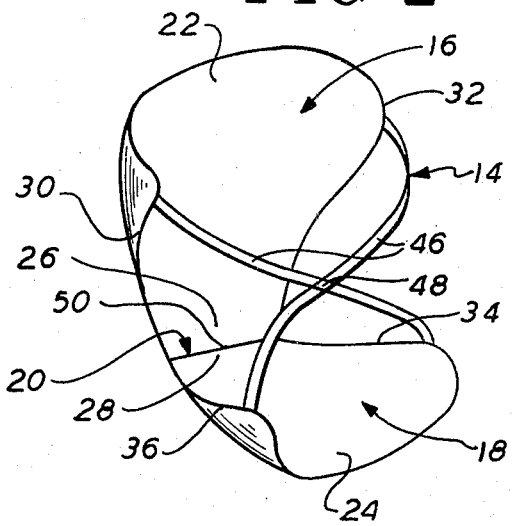
FIG. 2 is a perspective view showing the heel protector of the present invention in the open or operative position.
Figure 3:
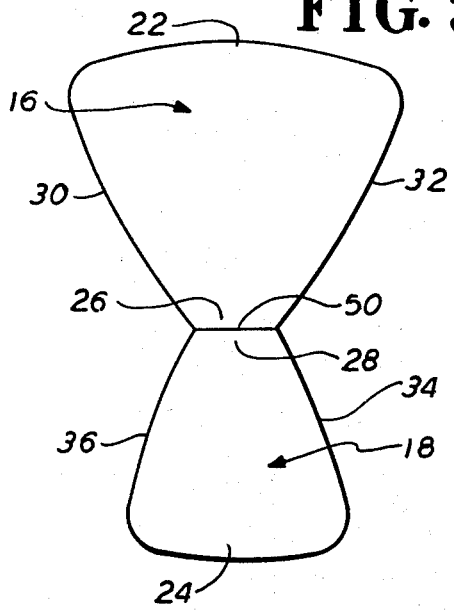
FIG. 3 is a plan view showing the heel protector of FIG. 2 with the cover means fully extended.

Returning now to FIGS. 2 and 3, flexible leaf members 16 and 18 each define a wide end and a narrow end, and tapering peripheral margins. Thus, wide end 22 of leaf member 16 corresponds generally to wide end 24 of leaf member 18, as do respective narrow ends 26 and 28, and peripheral margins 30 and 32, and 34 and 36. Referring to FIG. 3, the shape of leaf members 16 and 18 may, in a preferred embodiment, approximate a trapezoid, with the wide ends of the leaves disposed in approximately parallel relationship to the narrow ends. This configuration has the advantage of providing an ample shroud to both the back and bottom surfaces of the heel when the protector 10 is in place on the foot as shown in FIG. 1. Further, the flexible nature of the material constituting cover means 12 permits it to accommodate variations in shoe size and shape without the necessity of specific design modifications.

In a further embodiment, leaf members 16 and 18 may be of unequal size, and more particularly, leaf member 16 may be larger than leaf member 18. This is done, as leaf member 16 is adapted to reside against the back of the heel comprising the heel portion and counter of the shoe, and must accordingly be of greater size to accommodate variations in heel height. Correspondingly, leaf member 18 may be of smaller size, as it is only necessary that the leaf extend sufficiently along the bottom surface of the heel or shoe to provide sufficient leverage to enable web member member 14 to exert sufficient tension on leaf member 16 to draw it into snug engagement with the heel, as will be described in greater detail later on. Also, the size of leaf member 18 should be sufficient to afford maximum frictional contact with the bottom surface of the heel to assist in preventing slippage of heel protector 10 in use. In a preferred embodiment, leaf member 16 may be constructed with a longitudinal dimension of approximately 5 inches, a wide end of about 5½ inches and a narrow end of 2 inches, while leaf member 18 may define a longitudinal dimension of 3 inches, a wide end of about 3½ inches and a narrow end of 2 inches. The foregoing dimensions are provided for purposes of illustration only, however, and the invention is not believed to be limited to a particular size.

Figure 6:
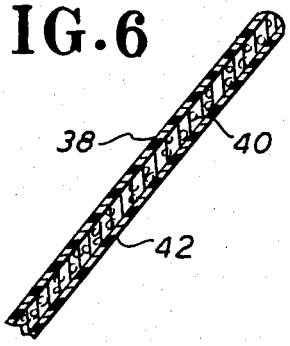
FIG. 6 is a sectional view illustrating a composite material useful in the fabrication of the present invention.

Cover means 12 may be constructed from a wide variety of flexible materials suitable for use in the protection of the heel of the wearer. Specifically, the materials found acceptable for the present invention may comprise elastic materials such as thin rubber, plastic or the like, or may also include textile materials, or leather. In a preferred embodiment, the cover means 12 is prepared from a composite material which provides a relatively non-resilient outer layer or sheet in combination with a relatively resilient inner pad or lining layer. Specifically, the outer layer may comprise a vinyl plastic, to which a foam inner layer is attached. Further, a cloth layer may be disposed over the foam pad to provide a more durable, softer inner surface for the reception of the heel of the wearer. The foregoing composite structure is illustrated in FIG. 6, wherein outer plastic layer 38 is shown in combination with interstitially located foam layer 40 and innermost textile or fabric layer 42. Naturally, those skilled in the art may select from a wide variety of materials possessing the desired characteristics mentioned above, and the invention is accordingly not limited to the specific materials disclosed and illustrated herein.

Figure 4:
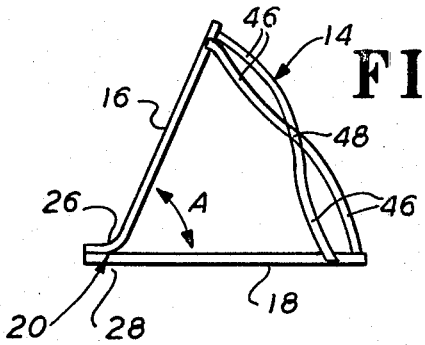
FIG. 4 is a side view illustrating one embodiment of the heel protector of the present invention.

Cover means 12 may be constructed in a variety of ways within the present invention. Specifically, as illustrated in FIG. 4, leaf members 16 and 18 may be fabricated from separate segments of flexible material, which are then joined as illustrated by juxtaposition of narrow ends 26 and 28 with the inner surfaces of the leaf members in abutment. In a particular embodiment, shown in FIG. 7, the narrow ends 26 and 28 may be joined simply by stitching depicted at 44. Naturally, other forms of union may be employed, such as heat-bonding, in the case of synthetic materials, stapling, gluing, and the like. Again, the invention is not limited to a particular form of bonding but rather encompasses all variations in such bonding within its spirit and scope.

Figure 5:
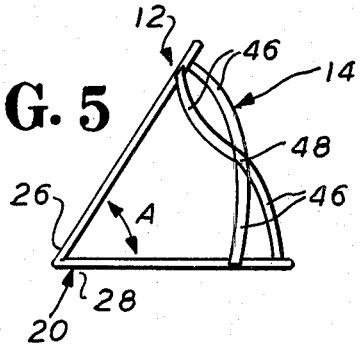
FIG. 5 is a side view illustrating a second embodiment of the heel protector of the present invention.

Referring now to FIG. 5, cover means 12 may be prepared from a unitary segment of flexible material, in which case, the general pattern outlined in FIG. 3 may be followed to cut the flexible material to achieve the final shape of the cover. A fully assembled heel protector illustrating this construction is shown in side view in FIG. 5.

The elastic means of the present invention, comprising web member 14 is shown in FIGS. 1, 2, 4 and 5 as generally X-shaped and connected to the respective peripheral margins of leaf members 16 and 18. Web member 14 comprises a plurality of transversely extending expandable straps 46 which make individual contact with the respective peripheral margins and join together at their opposite ends at a point of intersection 48, which lies intermediate the respective peripheral margins. Although the present illustrations depict four straps 46, it is to be understood that multiple straps could be employed in this invention. In an alternate embodiment, the straps 46 extending between peripheral margins 32 and 36, and 30 and 34, could comprise two continuous segments of strap material. Such continuous lengths of strap material could then be stitched to each other at intersection point 48. In a further variation, not illustrated specifically herein, the straps 46 connected, respectively, to peripheral margins 32 and 34 could be bonded to each other at intersection point 48 and made detachably attachable to a similar construction formed from the bonding of the straps 46 originating from peripheral margins 30 and 36. In this way, the present heel protector could be applied simply by placement about the heel and snapping or otherwise affixing together the respective straps 46 at the respective junction points just mentioned. Naturally, the present invention is susceptible of a wide variety of such modifications, and all such modifications are considered within its spirit and scope.

As noted earlier, the provision of web member 14 in the disposition defined by straps 46 and intersection 48 has the effect of drawing the respective peripheral margins, and therefore the wide ends of the leaf members 16 and 18 toward each other and into snug engagement with the respective side and bottom portions of the heel. Further, the web member 14 is adapted to be situated over the instep of the foot, with the result that greater wear and comfort is obtained. The elastic material comprising web member 14 is widely available and may be chosen in a variety of tensions to suit the conditions of use.

The present heel protector also includes a pocket formed by the junction of the narrow ends 26 and 28 of leaf members 16 and 18. Referring further to the figures, pocket 20 serves to provide a defined depression to receive the rear-most edge of the heel and to thereby assist in retaining the heel protector firmly in position thereagainst. Pocket 20 is seen in FIG. 2 to comprise an essentially straight line depression formed by the respective narrow ends, and, by its size is adapted to receive heels of varying width. In the instance where the leaf members 16 and 18 are prepared from separate segments of material subsequently bonded together, pocket 20 is easily formed by the assembly of the leaf members in the manner illustrated in FIGS. 4 and 7 and discussed earlier herein.

In addition to cradling the rear-most edge of the heel, pocket 20 is so configured that it assists in the biasing of leaf members 16 and 18 toward each other. Specifically, and referring to FIGS. 4 and 5, pocket 20, viewed laterally, in a manner equivalent to consideration of a lateral cross section, subtends an angle of less than 180° occurring between narrow ends 26 and 28. In the illustrations, the angle A lies within the preferred range of less than 90°. The flexible nature of the material comprising leaf members 16 and 18, and the biasing tension imposed at pocket 20, cause leaf members 16 and 18 to urge toward the juxtaposed, folded position illustrated in FIG. 7, when the protector is not in use. This tendency has the advantage of automatically reducing the bulk of the heel protector to make it easily accommodated into a man's pocket or briefcase, a ladies' purse or the like. Further, the biasing action imposed at pocket 20 assures that the pocket will maintain clear definition so that it may readily and repeatedly accept the rear-most edge of the heel in operation.

Figure 7:
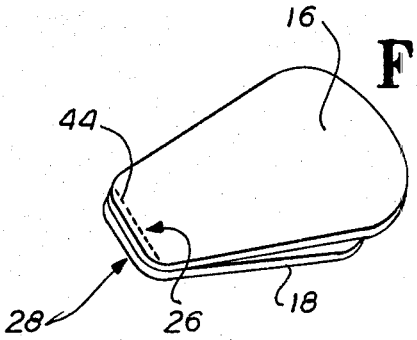
FIG. 7 is a perspective view illustrating the heel protector in the at rest position.

As noted earlier, pocket 20 may be easily prepared if the construction shown in FIGS. 4 and 7 is employed, as the mere stitching of the leaf members at narrow ends 26 and 28 will form the pocket. In the instance where a single segment of material is employed to prepare cover 12, pocket 20 may be formed by the folding of the cover 12 at the line separating narrow ends 26 and 28, followed by the application of heat under pressure, or glue, to permanently define the fold line 50 shown clearly in FIGS. 2 and 3. As noted earlier, fold line 50 is generally straight and is sufficiently long to accommodate variations in heel width.

The heel protector of the present invention may be assembled in a variety of ways as generally suggested above. In the instance where the cover means 12 is prepared from a single segment of material, the material may then be folded at the junction of narrow ends 26 and 28 and appropriately heat-bonded or glued to define pocket 20. Thereafter, straps 46 may be assembled to each other in the manner illustrated in the figures, either by sewing, or the provision of snaps, buckles or the like, after which they may then be attached to the respective peripheral margins by stitching, gluing, riveting or comparable means. In the instance where the material comprising cover 12 is of the composite nature illustrated in FIG. 6, the attachment of straps 46 may be accomplished by the insertion of the ends of the straps between the respective layers of the material, followed by the gluing, riveting or stitching of the material to retain the strap ends.

The above procedure may be followed with minor variation in the instance where the leaf members are prepared from separate segments of material. In such instance, the leaf members 16 and 18 may first be shaped from their respective starting materials, and then sewn or otherwise bonded together, as shown in FIG. 7. Naturally, the provision of pocket 20 in the manner illustrated herein suggests that the preferred method of assembly of leaf members 16 and 18 should follow the illustrations of FIGS. 4 and 7. However, it is to be understood that the respective leaf members could be attached by placement in overlap position, not shown followed by appropriate bonding, after which pocket 20 could be formed by folding and made permanent in the manner discussed with respect to FIG. 5, above.

The heel protector of the present invention is applied to the foot of the wearer by placement of the toe portion of the foot first through the loop defined by straps 46 connecting peripheral margins 30 and 32, followed by continued thrust of the toe through the second loop defined by strap segments 46 connecting peripheral margins 34 and 36. Thereafter, the heel protector is moved up the foot into the position shown in FIG. 1, where straps 46 of web member 14 tend to pull the leaf members about the back and bottom surfaces of the heel. Removal of the heel protector is likewise easily accomplished by simply sliding the protector down along the foot and off the toe.

The compact construction of the present heel protector makes it simple to manufacture and use, and the biasing action of pocket 20 between leaf members 16 and 18 assists the heel protector in folding into compact size and shape for storage when not in use.

The heel protector may be manufactured in a wide variety of colors to suit the requirements and desires of the end users. The invention is accordingly not limited to the choice of colors or other indicia of appearance, but rather is intended to encompass all such variations within its scope.

It is to be understood that the invention is not limited to the illustrations described and shown herein, which are deemed to be merely illustrative of the best modes of carrying out the invention, and which are suitable of modifications of form, size, arrangement of parts and details of operations. The invention rather is intended to encompass all such modifications which are within the spirit and scope and defined by the claims.

What is claimed is:

1. A heel protector for use by both men and women to prevent abrasion of the heel while operating a motor vehicle which comprises:

a generally hourglass-shaped, flexible cover means adapted to shroud the back and bottom surfaces of said heel, said cover means including two leaf members, each leaf member having a wide end, a narrow end and tapering peripheral margins extending therebetween, said leaf members joined to each other at said narrow ends, a pocket defined by said narrow ends to cradle the rearmost leading edge of said heel, and elastic means adapted to extend around the instep of the wearer to hold said heel protector in position comprising a generally X-shaped web member connecting the peripheral margins of said leaf members, wherein said web member draws said leaf members toward each other and into snug contact with the back and bottom surfaces of said heel when said heel protector is placed over the heel and instep of the wearer.

2. The heel protector of claim 1 wherein said leaf members comprise, respectively, a first larger leaf member adapted to shroud the back surface of said heel, and a second smaller leaf member adapted to shroud the bottom surface of said heel.

3. The heel protector of claim 1 wherein both of said leaf members have a generally trapezoidal shape with wide ends and narrow ends essentially parallel to each other.

4. The heel protector of claim 1 wherein said leaf members are prepared from separate pieces of flexible material, and are attached to each other at said narrow ends.

5. The heel protector of claim 1 wherein said cover means is prepared from a composite flexible material, said composite material comprising a relatively non-resilient, outwardly facing sheet, and a relatively resilient inwardly facing lining attached thereto.

6. The heel protector of claim 1 wherein said leaf members are biased toward each other so as to be foldable one upon the other when said heel protector is not in use.

7. The heel protector of claim 6 wherein said pocket, in lateral cross section, subtends an angle of less than 180°.

8. The heel protector claim 7 wherein said angle is less than 90°.

9. The heel protector of claim 1 wherein said pocket is defined by a generally straight fold line formed by the intersection of said narrow ends.

10. The heel protector of claim 9 wherein said leaf members are prepared from separate segments of material, and said straight fold line is defined by a bond formed between said narrow ends while said leaf members are disposed in face-to-face juxtaposition and alignment.

11. The heel protector of claim 1 wherein said X-shaped web member comprises a plurality of transversely extending expandable straps connecting said peripheral margins.

12. The heel protector of claim 1 wherein said web member comprises two straps disposed in criss-cross relationship to each other, and which extend to connect diametrically opposed peripheral margins.

13. The heel protector according to claim 11 or 12 wherein said straps are connected to each other at a point of intersection lying intermediate said peripheral margins.

14. A heel protector for use by both men and women to prevent abrasion of the heel while operating a motor vehicle which comprises:

a generally hourglass-shaped, flexible cover means adapted to shroud the back and bottom surfaces of the heel, said cover means comprising a first larger leaf member, and a second smaller leaf member, each leaf member having a generally trapezoidal shape defining a wide end, a narrow end essentially parallel to said wide end, and tapering peripheral margins extending between said wide end and said narrow end, said leaf members attached to each other at said narrow ends, a pocket formed by the attachment of said narrow ends to cradle the rear-most leading edge of the heel of the wearer, said pocket in lateral cross section, subtending an angle of less than 180°, and elastic means adapted to extend around the instep of the wearer to hold said heel protector in position comprising a plurality of transversely disposed, expandable straps attached to diametrically opposed peripheral margins, and extending therebetween to connect said first and said second leaf members, said straps connected to each other at a point of intersection lying intermediate said peripheral margins, wherein said straps draw said leaf members toward each other and into snug contact with the back and bottom surfaces of said heel, when said heel protector is placed over the heel and instep of the wearer.

* * * * *